US010450182B2

(12) United States Patent
Bell

(10) Patent No.: US 10,450,182 B2
(45) Date of Patent: Oct. 22, 2019

(54) LIQUID DISPENSING SYSTEM

(71) Applicant: CATA, LLC, Whitefish Bay, WI (US)

(72) Inventor: Jessica L. Bell, Whitefish Bay, WI (US)

(73) Assignee: Cata, LLC, Whitefish Bay, WI (US)

( * ) Notice: Subject to any disclaimer, the term of this patent is extended or adjusted under 35 U.S.C. 154(b) by 0 days.

(21) Appl. No.: 16/102,861

(22) Filed: Aug. 14, 2018

(65) Prior Publication Data

US 2019/0055114 A1 Feb. 21, 2019

Related U.S. Application Data

(60) Provisional application No. 62/545,590, filed on Aug. 15, 2017.

(51) Int. Cl.

| | |
|---|---|
| ***B67D 3/00*** | (2006.01) |
| ***B65D 77/06*** | (2006.01) |
| ***B67D 1/10*** | (2006.01) |
| ***B67D 1/04*** | (2006.01) |
| ***B67D 1/08*** | (2006.01) |
| *B67D 1/00* | (2006.01) |

(52) U.S. Cl.

CPC ..... *B67D 3/0009* (2013.01); *B65D 77/067* (2013.01); *B67D 1/0462* (2013.01); *B67D 1/0891* (2013.01); *B67D 1/10* (2013.01); *B67D 3/0051* (2013.01); *B67D 3/0067* (2013.01); *B67D 2001/0097* (2013.01); *B67D 2001/0827* (2013.01)

(58) Field of Classification Search

CPC ..... B67D 1/0462; B65D 77/06

See application file for complete search history.

(56) References Cited

U.S. PATENT DOCUMENTS

| | | | |
|---|---|---|---|
| 4,359,174 A | 11/1982 | Ikunosuke et al. | |
| 6,431,400 B1 | 8/2002 | O'Maley et al. | |
| 7,798,373 B1 | 9/2010 | Wroblewski et al. | |
| 8,763,857 B2 | 7/2014 | Middleton | |
| 8,991,649 B2 | 3/2015 | Wegelin et al. | |
| 9,475,682 B2 | 10/2016 | Middleton | |
| 10,106,393 B1 * | 10/2018 | Russell | B67D 1/0462 |

(Continued)

FOREIGN PATENT DOCUMENTS

| | | | | |
|---|---|---|---|---|
| EP | 2154102 | * | 2/2010 | B67D 1/0462 |

*Primary Examiner* — J C Jacyna

(74) *Attorney, Agent, or Firm* — Bell & Manning, LLC; N. Meredith Porembski

(57) ABSTRACT

A liquid dispensing system for dispensing a liquid comprises an insulated housing comprising a top wall and a side wall mounted to the top wall, the side wall extending downwardly from the top wall to define an interior configured to receive a refill container comprising a liquid; a bottom surface mounted to the housing at a mounting interface and configured to enclose the interior of the housing; a sloped surface mounted within the interior of the housing and configured to induce the liquid within the refill container to flow toward a dispensing aperture through which the liquid is dispensed from the system; and a pump assembly in fluid communication with the interior of the housing, the pump assembly comprising a gas source and configured to deliver a gas from the gas source to the interior of the housing to apply pressure to the refill container.

15 Claims, 21 Drawing Sheets

(56) References Cited

U.S. PATENT DOCUMENTS

| | | | | |
|---|---|---|---|---|
| 2005/0268985 | A1* | 12/2005 | Litto | B67D 1/0462 141/67 |
| 2009/0236361 | A1* | 9/2009 | Doelman | B67D 1/0082 222/1 |
| 2017/0015545 | A1* | 1/2017 | Derby | B65D 21/08 |

* cited by examiner

LIQUID DISPENSING SYSTEM

CROSS-REFERENCE TO RELATED APPLICATIONS

The present application claims priority to U.S. Provisional Patent Application No. 62/545,590 that was filed Aug. 15, 2017, the entire contents of which are hereby incorporated by reference.

BACKGROUND

There are currently over 100 million wine drinkers in the United States alone, as compared to about half that for beer and spirits. This is a relatively recent trend that is projected to grow, as America's Millennials have demonstrated a preference for wine over beer.

The American wine consumer is becoming younger, more feminine and more cost conscious. A beverage once reserved for wealthier, higher educated Americans to enjoy only at dinner and special occasions is now a beverage for the masses, enjoyed at the most casual of settings, including pools, beaches, camping, concert and sporting events. The use of glass is not ideal or permitted at these venues or occasions, and yet traditional wine consumption practices are predicated on the use of a GLASS bottle and a GLASS tumbler. As a result, the actual or perceived quality of wine at non-glass venues is greatly diminished when served in a plastic cup or from a delivery system that does not convey quality and experience.

There exist few solutions that address the need for mass dispensing of wine in non-glass settings that satisfy both the concessionaire's need for cost and convenience AND the consumer's desire for experience and quality. Most concession providers resort to serving wine out of a conventional 750 ml bottle which is not only inefficient for service time, but it also results in a good amount of product loss. Also the product cost are higher because bottles are relatively expensive and costly to ship when compared to wine stored and shipped in bags. Alternatively, concessionaires have begun to offer sealed single-serving wine cups, but these options are unappealing to most wine drinkers because the quality is low and the experience has little to do with what they associate with the desired wine experience and taste.

There are significant and growing numbers of wine drinkers seeking wine in non-glass environments. For instance, 50 million of the 75 million American baseball fans are wine drinkers, and yet wine sales only account for about 5-10% of alcohol sales at large-scale, non-glass venues hosting sporting events, concerts, fairs and festivals. This glaring discrepancy begs the question, "Why?"

SUMMARY

Provided are liquid dispensing systems and refill containers for use in such systems. The present liquid dispensing systems and its components are designed to create a low-cost, efficient manner for dispensing beverages, e.g., wine, for which temperature and freshness greatly affect the taste and experience of the beverage, so that the consumer will receive a good quality product that meets their expectations for what constitutes a pleasant taste and experience.

In one aspect, liquid dispensing systems are provided. In an embodiment, a liquid dispensing system for dispensing a liquid comprises an insulated housing comprising a top wall and a side wall mounted to the top wall, the side wall extending downwardly from the top wall to define an interior configured to receive a refill container comprising a liquid; a bottom surface mounted to the housing at a mounting interface and configured to enclose the interior of the housing; a sloped surface mounted within the interior of the housing and configured to induce the liquid within the refill container to flow toward a dispensing aperture through which the liquid is dispensed from the system; and a pump assembly in fluid communication with the interior of the housing, the pump assembly comprising a gas source and configured to deliver a gas from the gas source to the interior of the housing to apply pressure to the refill container.

In another embodiment, a dispensing system for dispensing a liquid comprises an insulated housing comprising a top wall and a side wall mounted to the top wall, the side wall extending downwardly from the top wall to define an interior configured to receive a refill container comprising a liquid; a base mounted to an end of the housing opposite the top wall at a mounting interface and via a gas-tight seal, the base comprising a side wall extending downwardly from the side wall of the housing and a floor mounted to the side wall, the floor configured to enclose the interior of the housing; a sloped surface mounted within the interior of the housing and configured to induce the liquid within the refill container to flow toward a dispensing aperture through which the liquid is dispensed from the system; and a pump assembly in fluid communication with the interior of the housing, the pump assembly comprising one or more pumps mounted in an interior defined by the side wall and floor of the base, the one or more pumps configured to deliver a gas to the interior of the housing to apply pressure to the refill container.

In another embodiment, a dispensing system for dispensing a liquid comprises an insulated housing comprising a top wall and a side wall mounted to the top wall, the side wall extending downwardly from the top wall to define an interior configured to receive a refill container comprising a liquid, the insulated housing open at an end opposite the top wall; a base mounted to the open end of the housing opposite the top wall at a first mounting interface which forms a gas-tight seal, the base comprising a side wall extending downwardly from the side wall of the housing and a floor mounted to the side wall of the base, the floor configured to enclose the interior of the housing; a sloped surface mounted within the interior of the housing and configured to induce the liquid within the refill container to flow toward a dispensing aperture configured to receive a spout of the refill container at a second mounting interface which forms another gas-tight seal, through which spout the liquid is dispensed from the system; and a pump assembly in fluid communication with the interior of the housing, the pump assembly comprising a gas source and configured to deliver a gas from the gas source to the interior of the housing to apply pressure to the refill container. In this embodiment, the side wall of the housing and the side wall of the base together define the dispensing aperture, and the second mounting interface extends from the first mounting interface.

In another aspect, methods of dispensing a liquid using the disclosed systems are also provided. Relative to the illustrative systems described above, in an embodiment, the method comprises inserting the refill container into the interior of the housing; dispensing a portion of the liquid within the refill container through the dispensing aperture; delivering gas from the gas source to the interior of the housing, thereby applying pressure to the refill container; and dispensing an additional portion of the liquid within the refill container through the spout.

Other principal features and advantages of the present disclosure will become apparent to those skilled in the art upon review of the following drawings, the detailed description, and the appended claims.

BRIEF DESCRIPTION OF THE DRAWINGS

Illustrative embodiments of the present disclosure will hereafter be described with reference to the accompanying drawings.

DETAILED DESCRIPTION

Provided are liquid dispensing systems and refill containers for use in such systems. In one aspect, a liquid dispensing system is provided. The liquid dispensing system is configured to maintain a selected temperature of a liquid, e.g., a beverage such as wine, and to dispense the liquid from a refill container housed within the liquid dispensing system. The selected temperature may be in a range of from about 37° F. to about 72° F. The liquid dispensing system comprises a housing for enclosing a refill container and may comprise one or more of the refill container, a base, an insert, and a pump assembly. Each of these components is further described in more detail, below.

Figure 1C:
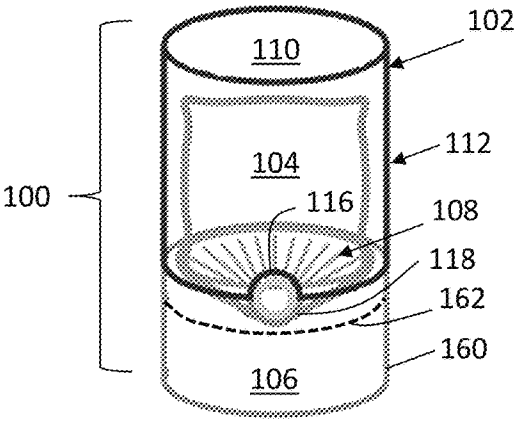
FIG. 1C shows a front, assembled view of the system.
Figure 1B:
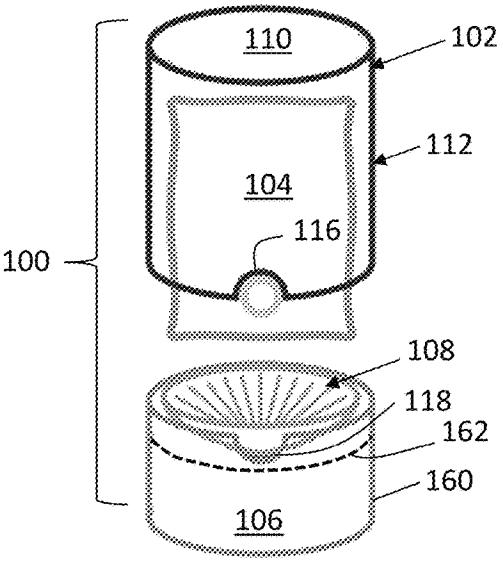
FIG. 1B shows a front, partially assembled view of the system.
Figure 1A:
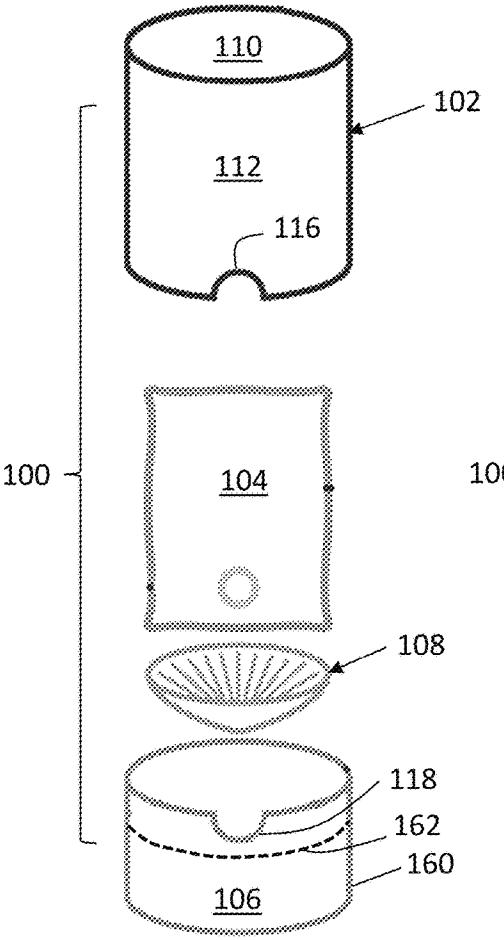
FIG. 1A shows a front, disassembled view of a liquid dispensing system according to an illustrative embodiment.

An illustrative liquid dispensing system 100 is shown in FIGS. 1A-1C. FIG. 1A shows a front, disassembled view of the system 100. FIG. 1B shows a front, partially assembled view of the system 100. FIG. 1C shows a front, assembled view of the system 100. Some surfaces of the components of the system 100 are shown without shading so as to visualize the internal contents of the system 100. These figures show that the system 100 includes a housing 102, a refill container 104, a base 106 and an insert 108.

Housing

The housing 102 is configured to receive at least a portion (or all) of the refill container 104. The housing 102 is also configured to minimize or prevent the transfer of heat through the housing 102 so as to maintain the selected temperature within an interior of the housing 102 (and thus of contents therein, e.g., the liquid in the refill container 104). As such, the housing 102 may be referred to as an insulated housing. The housing 102 includes a top wall 110 and a side wall 112 mounted to the top wall 100 and extending downwardly from the top wall 110. The side wall 112 is formed as a cylinder. The housing 102 does not include a bottom wall, i.e., the housing 102 is open at the end opposite the top wall 110. However, as described below, a bottom surface may be provided by another component (e.g., the base 106) mounted to the housing 102 in order to enclose the interior of the housing, i.e., so that the interior is surrounded on all sides.

Although the housing 102 includes the top wall 110 and the side wall 112, in general, a housing may include one or more walls defining an interior. The number of walls, the shape of the walls, and the dimensions of the walls are not particularly limited. Instead, these parameters may be selected depending upon the application environment for the system 100 (e.g., personal use versus commercial), the configuration of the refill container 104, etc.

Figure 2:
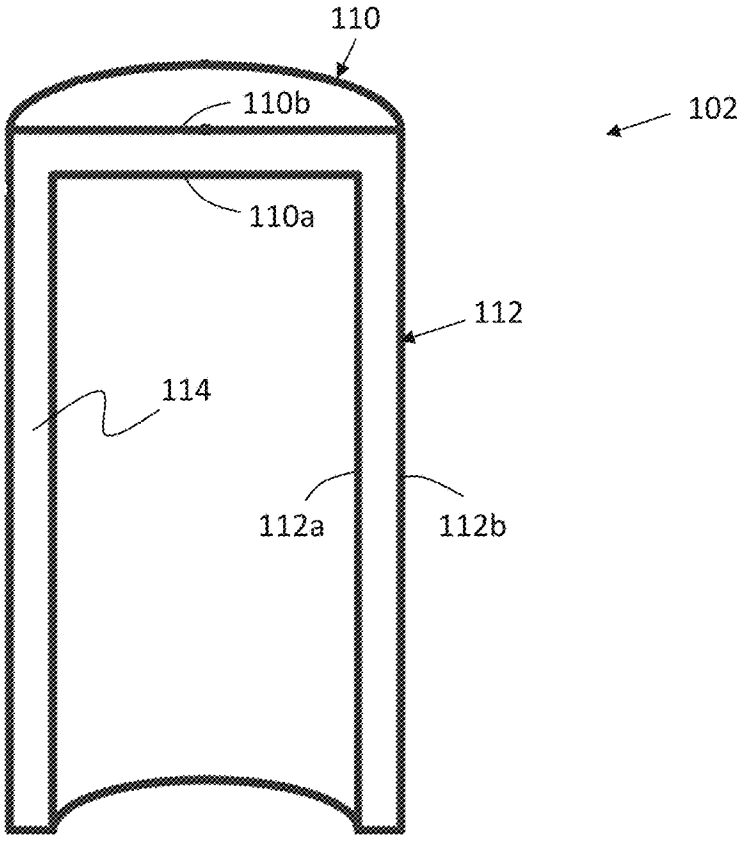
FIG. 2 shows a front, cross-sectional view of a housing of the system of FIGS. 1A-1C.

FIG. 2 shows a front, cross-sectional view of the housing 102. This figure shows that the top wall 110 and the side wall 112 are actually "double walls," including inner walls 110*a*, 112*a* (respectively) and outer walls 110*b*, 112*b* (respectively). Each inner wall 110*a*, 112*a* is separated from its corresponding outer wall 110*b*, 112*b* to define a gap 114 in between. The gap 114 may be filled with an insulating material (e.g., Styrofoam or another polymeric insulating material). Alternatively, the gap 114 may be evacuated to form a vacuum. Either way, each inner wall 110*a*, 112*a* and its corresponding outer wall 110*b*, 112*b* may be permanently mounted together (with the insulating material/vacuum in between), e.g., via a seal. Although all walls of the housing 102 may be double walls, in other embodiments, a subset of the walls may be double walls. In addition, the entire portion of any particular wall may a double wall, or less than the entire portion.

Although not shown in this embodiment, one or more walls (or double walls) of the housing 102 may be partially or completely removeable (e.g., via vertically sliding, horizontally sliding, hinging, bending, etc.) from an adjoining wall (or double wall). An opening in the housing 102 created by partial/complete removal of a wall provides access to the interior of the housing 102 (e.g., so as to insert/remove the refill container 104). However, as shown in FIGS. 1A-1B, access to the interior of the housing 102 may be achieved via the open end of the housing 102 after detaching the housing 102 from the base 106.

Figures 6A, 6B, 6C:
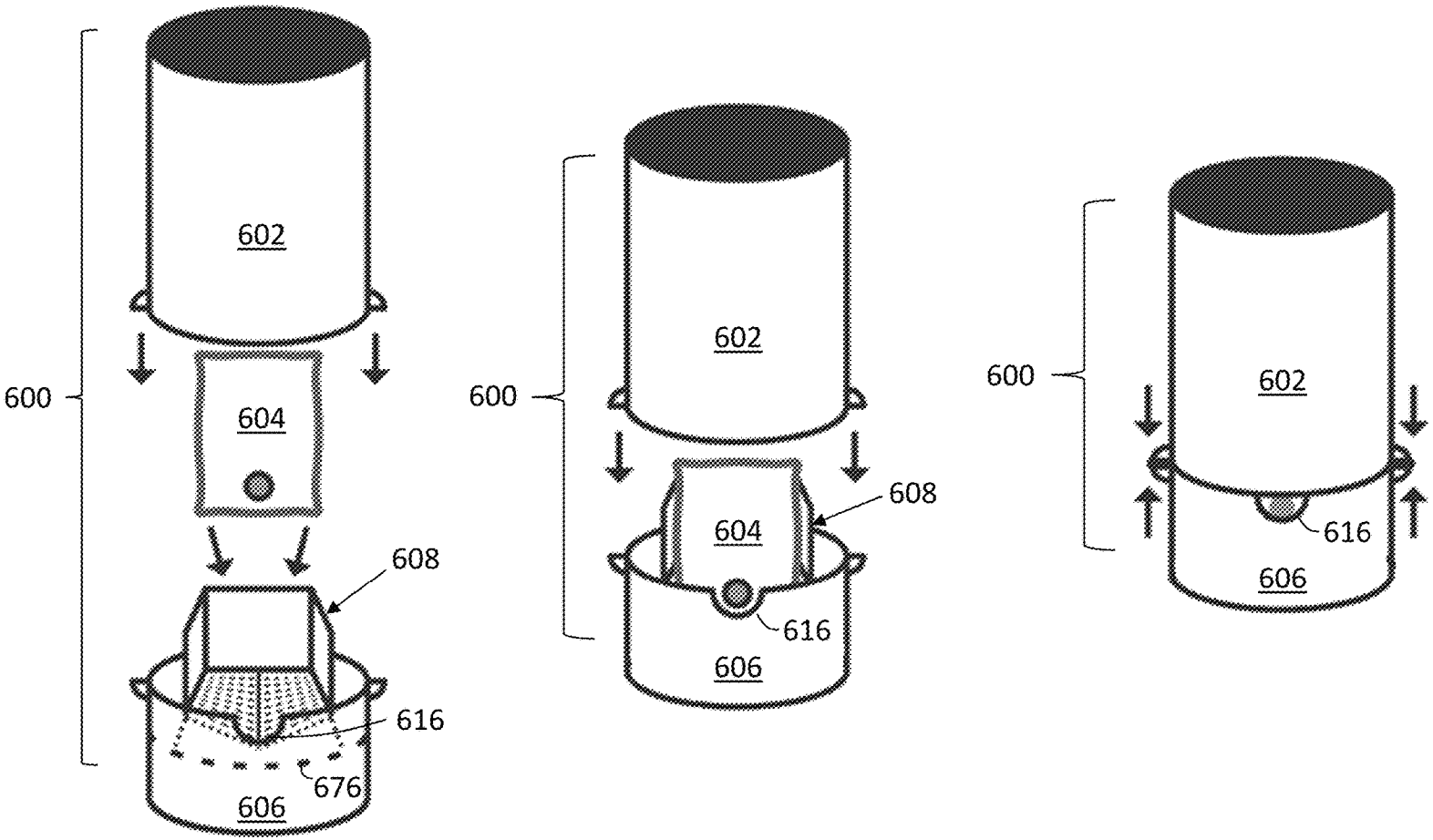
FIG. 6A shows a front, disassembled view of a liquid dispensing system according to another illustrative embodiment.
FIG. 6B shows a front, partially assembled view of the system.
FIG. 6C shows a front, assembled view of the system.

The side wall 112 defines a dispensing aperture 116 configured to receive a spout (not shown here, but see a spout 430 of FIGS. 4A-4B) mounted to the refill container 104. The shape and dimensions of the dispensing aperture 116 are not particularly limited, but may be selected depending upon the configuration of the spout. The dispensing aperture 116 may be defined in both the inner wall 112*a* and the outer wall 112*b* of the housing 102 so that the dispensing aperture 116 extends through the double wall from the interior of the housing 102 to the exterior. The dispensing aperture 116 has a semi-circular shape and another aperture 118 (also semi-circular in shape) is formed in a side wall of the base 106 so as to form a circular aperture when the housing 102 is mounted to the base 106. However, other configurations may be used. For example, as shown in FIG. 4A, a circular aperture 416 may be formed in a side wall of a housing 402. In addition, as shown in FIGS. 6A-6C, a semi-circular aperture 616 may be formed in a side wall of a base 606. As another illustrative embodiment, as shown in FIG. 10C (which will be further described below), an aperture 1031 may be formed in a side wall of a collar 1092 mounted to a housing 1002. The exact position of the dispensing aperture 116 is not particularly limited, but it may be positioned within the bottom third of the housing 102 or within the bottom half of the structure when the housing 102 is attached to the base 106.

Although not shown in this embodiment, a dispensing aperture may be formed in a tab(s) partially or completely releasably mounted (e.g., via hinging, sliding, etc.) to a side wall of a housing and positioned within another larger aperture formed in the side wall of the housing. When attached or slid into place, the tab(s) may snap or lock into place, preventing a spout of a refill container from moving and/or preventing air flow between the interior of the housing and ambient air.

Figure 5B:
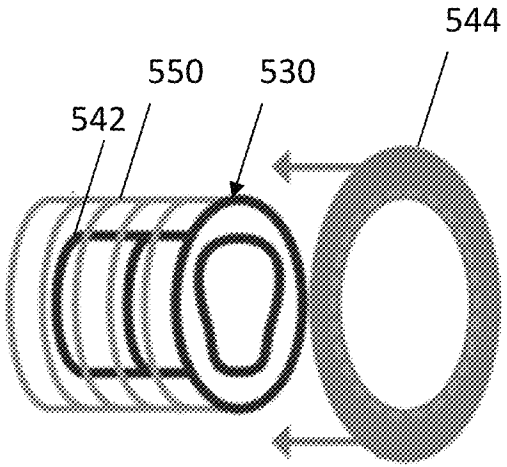
FIG. 5B shows a collar and a ring mounted to a spout of the refill container.
Figure 5A:
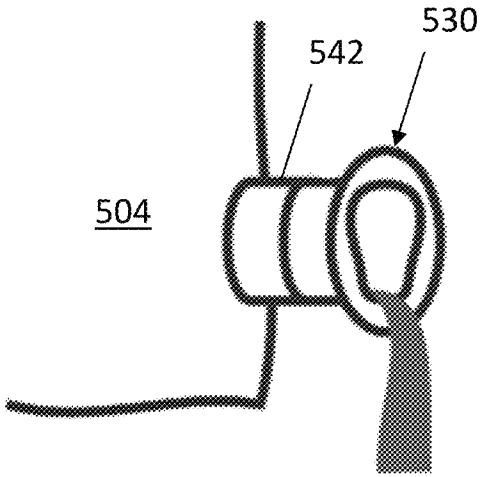
FIG. 5A shows a portion of a refill container according to an illustrative embodiment.

A flexible, polymeric (e.g., silicone, polypropylene, etc.) lining (e.g., ring) may be mounted to an inside surface of the dispensing aperture 116. This is illustrated in FIG. 10C, showing a groove 1033 formed in an inside surface of the aperture 1031. The lining may be configured to allow the spout of the refill container 104 to pass through from the interior of the housing 102 to the exterior. However, once the spout is in place, the lining may be configured to reduce the spout's movement and/or reduce/prevent gas from passing from the interior of the housing 102 to the exterior through the dispensing aperture 116. Alternatively, the lining may be mounted onto a portion of the spout. This is illustrated in FIGS. 5A-5B. FIG. 5A shows a portion of a refill container 504 including a spout 530 mounted thereon. As shown in FIG. 5B, a collar 550 is releasably or permanently mounted to a neck 542 of the spout 530 and a lining in the form of a ring 544 is releasably or permanently mounted to the collar 550.

Figure 4B:
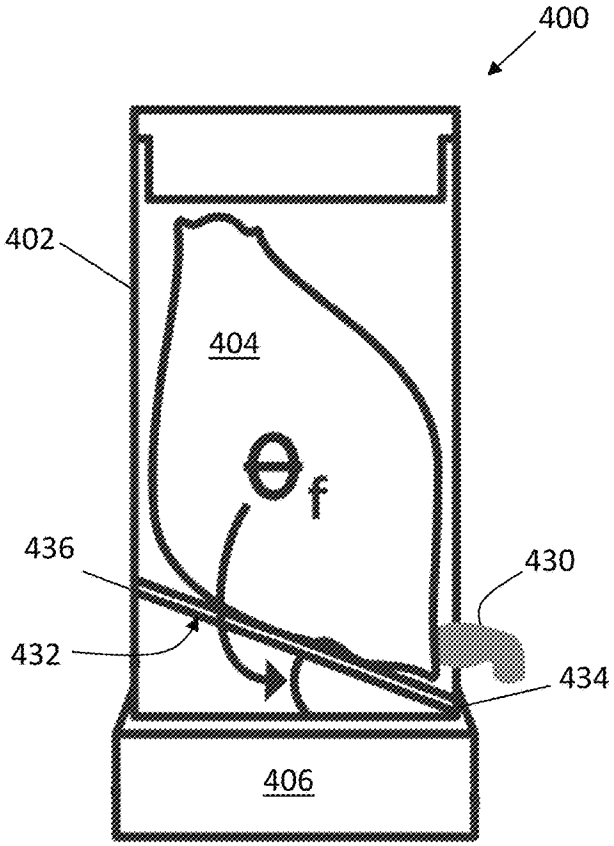
FIG. 4B shows a side, perspective view of the system.
Figure 4A:
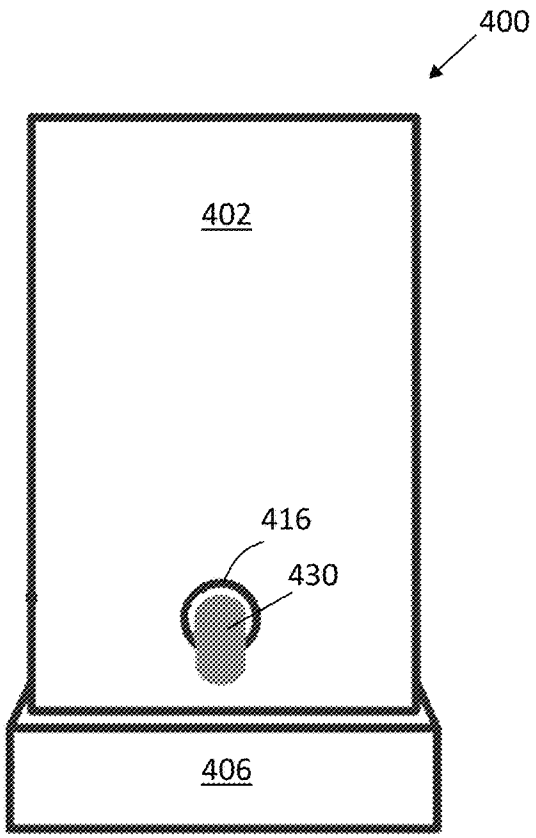
FIG. 4A shows a front, perspective view of a liquid dispensing system according to another illustrative embodiment.

Another embodiment of a liquid dispensing system 400 is shown in FIGS. 4A-4B. FIG. 4A shows a front, perspective view of the system 400 and FIG. 4B shows a side, perspective view of the system 400. The system 400 includes a housing 402, a refill container 404, and a base 406. Side walls of the housing 402 are rectangularly shaped and a top wall is formed as a lid inserted between side walls. The circular-shaped dispensing aperture 416 is formed in one of the side walls. The dispensing aperture 416 receives the spout 430 mounted to the refill container 404. The housing 402 includes a sloped floor 432 releasably or permanently mounted within the housing 402. Although the exact position within the interior of the housing 402 is not particularly limited, the sloped floor 432 may be positioned near a bottom end of the housing 402 and sloped such that an edge 434 of the sloped floor 432 proximate the dispensing aperture 416 is lower and the opposing edge 436 is higher. This way, liquid within the refill container 404 resting on the sloped floor 432 will flow towards and pool next to the dispensing aperture 416. An angle $\theta_f$ formed between a bottom surface of the sloped floor 432 and an underlying horizontal surface (e.g., a bottom wall of the housing 402, a bottom wall or floor of the base 406, or a countertop, etc.) may be selected to facilitate liquid flow/pooling next to the dispensing aperture 416.

In general, when a sloped floor is used, it may assume various configurations. By way of illustration, a sloped floor may be formed from two (or more) sloped surfaces, forming a V-shaped cross-section (see an insert 608 of FIGS. 6A, 7). As shown in FIGS. 4A-4B, the sloped floor 432 may be an additional component of the housing 402 and mounted therein, e.g., to an inside surface(s) of the side wall(s). However, a bottom wall of the housing 402 may be sloped to provide a sloped floor. Alternatively, a sloped floor may be provided by another component of the liquid dispensing system, e.g., a base 406 or an insert mounted within the housing (e.g., see the insert 108 of FIGS. 1A-1C and the insert 608 of FIGS. 6A, 7). A sloped floor may be perforated to allow for condensation or other liquids to drain. A sloped floor may have a constant slope or a variable slope so that the sloped floor is curved along one or more directions across its surface. A sloped floor may be permanently or releasably mounted (e.g., by way of twisting, snapping or simply resting on an underlying surface).

Another embodiment of a liquid dispensing system 600 is shown in FIGS. 6A-6C FIG. 6A shows a front, disassembled view of the system 600. FIG. 6B shows a front, partially assembled view of the system 600. FIG. 6C shows a front, assembled view of the system 600. Some surfaces of the components of the system 600 are shown without shading so as to visualize the internal contents of the system 600. These figures show that the system 600 includes a housing 602, a refill container 604, the base 606 and the insert 608. Some of the different features of the system 600 as compared to the system 100 have been described above while others will be described below.

Refill Container

As shown in FIGS. 1A-1C, the system 100 includes the refill container 104 mounted to the housing 102 and at least partially enclosed within the interior of the housing 102. (See also the refill containers 404 and 604 of FIGS. 4B and 6A-6C.) The refill container 104 is configured to receive the liquid to be dispensed and to dispense the liquid therein. A variety of materials may be used to form the refill container 104, although the material is desirably inert so as not to materially affect the characteristics (e.g., taste) of the liquid contained therein, and conformable (i.e., flexible to adopt a shape corresponding to surfaces with which the refill container is in contact). Illustrative materials include food/beverage grade polymeric materials.

The refill container 104 includes a spout mounted thereon through which the liquid may be dispensed upon demand, e.g., by a user pressing a button mounted to the spout. The configuration of the spout is not particularly limited, although the position of the spout is desirably near a bottom end of the refill container 104. The circles at the bottom ends of the refill containers 104 and 604 of FIGS. 1A-1C and 6A-6B, respectively, mark the location of the spout. As shown in these figures, the spout may be centered at the bottom end, but off-center positions may also be used. As noted above, other illustrative spouts 430, 530 are shown in FIGS. 4A-4B and 5A-5B, respectively.

The refill container 104 may be, but need not be, actively mounted to an interior surface of the system 100 (e.g., by pegs, hook, clips, etc.). However, as shown in FIGS. 1A-1C, the refill container 104 may freely rest on an underlying surface, e.g., a surface of the inert 108.

In general, the outer shape and the dimensions of a refill container are not particularly limited. As shown in FIGS. 1A-1C, a rectangular shape may be used, although corners of a bottom end of the refill container 104 may be flattened or removed to funnel liquid towards the spout.

A refill container may be referred to as a bag or a liquid bladder.

Base

As shown in FIGS. 1A-1C, the system 100 further includes the base 106 mounted to the bottom end of the housing 102. (See also the bases 406 and 606 of FIGS. 4A-4B and 6A-6C, respectively.) This base 106 provides a support and mounting surface for the housing 102. The base 106 may be configured to provide one or more functionalities described above, e.g., at least partially enclosing the refill container 104, insulating the interior of the housing 102, providing an aperture for the spout of the refill container 104, providing a sloped floor on which the refill container 104 or the insert 108 rests, etc.

The base 106 includes a side wall 160, extending downwardly from the side wall 112 of the housing 102 (once mounted thereto). The side wall 160 is formed as a cylinder. In general, as described above with respect to a housing, a base may include one or more walls defining an interior, with the number of walls, the shape of the walls, and the dimensions of the walls not being particularly limited. Similarly, none, some, or all of the walls of a base may be double walls.

In this embodiment, the base 106 includes a floor 162 mounted to the side wall 160. The floor 162 may provide a support surface on which the insert 108 rests. In addition, floor(s) can define interior compartments within the base 106 which may be used for insulation (e.g., filled with Styrofoam or evacuated to a vacuum), cooling (e.g., containing a cooling unit such as an ice pack), or storage. In general, the position of any floor(s) with respect to a side wall of a base is not particularly limited. In the embodiments of FIGS. 1A-1C and 6A-6C, floor(s) are positioned between an upper and lower edge of side walls of the bases 106, 606. However, raised floor(s) may also be used, e.g., such that a surface of the raised floor extends above an upper edge of a side wall of a base into the interior of a housing. This will be described with reference to FIGS. 10A-10E, below.

Figure 3:
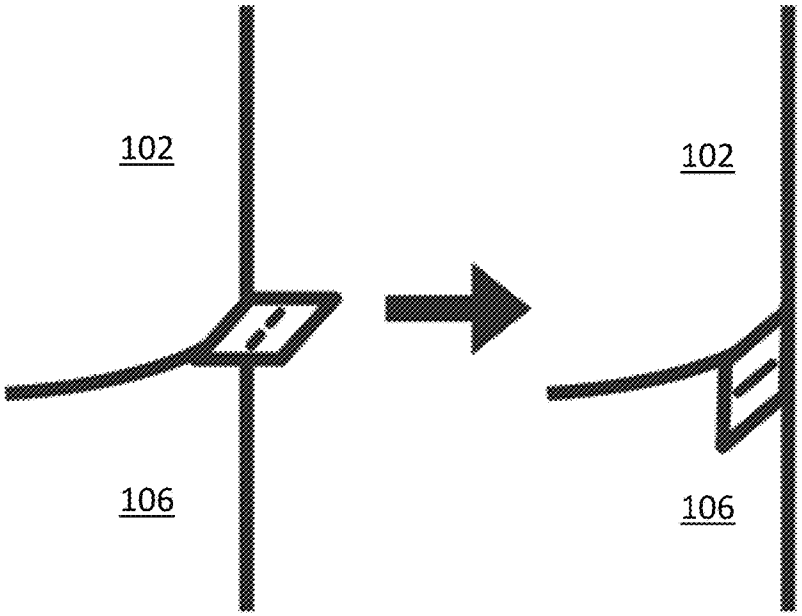
FIG. 3 shows a portion of a perspective view of the system of FIGS. 1A-1C to illustrate mounting of the housing to a base of the system.
Figure 8:
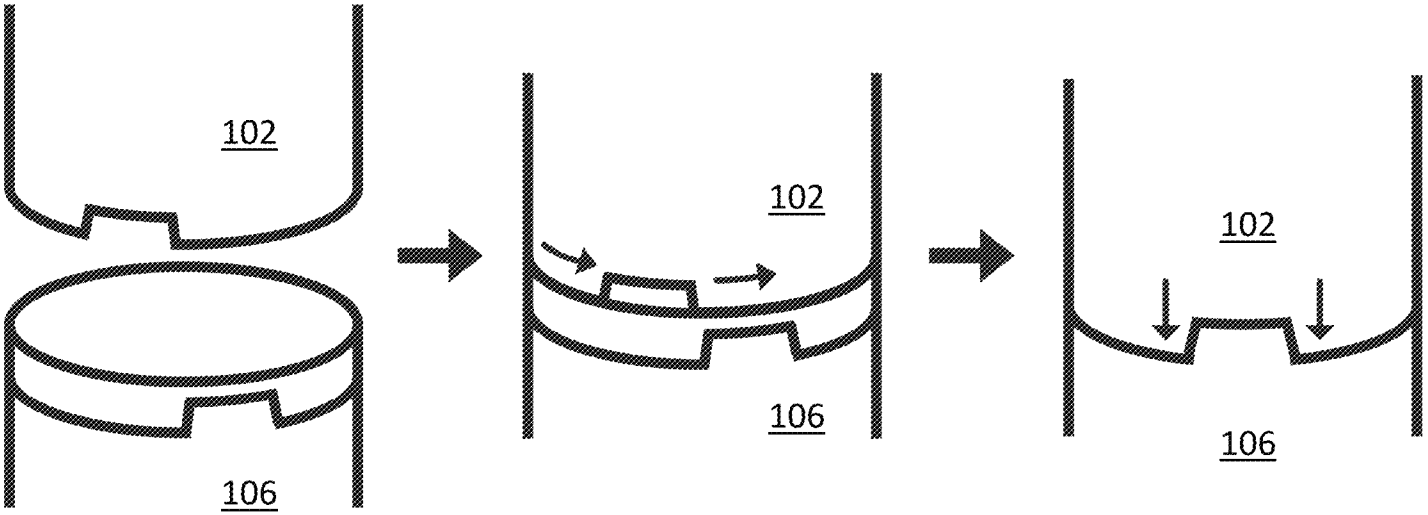
FIG. 8 shows a portion of a perspective view of the system of FIGS. 1A-1C to illustrate mounting of the housing to the base of the system.

The housing 102 and the base 106 may be mounted together using a variety of techniques, e.g., locking, snapping, twisting, threading, etc. By way of illustration, two different snap mountings are shown in FIG. 3 (showing a portion of the housing 102 mounted to the base 106) and FIGS. 6A-6C (showing the housing 602 mounted to the base 606). A lock mounting is shown in FIG. 8 (showing a portion of the housing 102 mounted to the base 106). Another mounting is described below with reference to FIGS. 12A-12C, 13A-13C, 14 and 15A-15B.

Although not shown in FIGS. 1A-1C, a gasket or ring may be positioned between the housing 102 and the base 106, e.g., in a groove formed in one or both edges of the housing 102 and the base 106 in order to prevent/minimize gas from passing from the interior of the housing 102 to the exterior when the housing 102 is mounted to the base 106. As further described below, this is useful when a pump assembly is included in the system 100.

Insert

As shown in FIGS. 1A-1C, the system 100 further includes the insert 108 mounted on a surface of the base 106. The insert 108 provides a support surface on which the refill container 104 may rest. The insert 108 may also be configured to provide at least some of the functionalities described above, e.g., providing a sloped floor. In this embodiment, the insert 108 is formed in the shape of a cone. Thus, the sloped walls of the cone provide the sloped floor on which the refill container 104 rests, as described above. In this embodiment, the sloped walls of the cone slope towards the center of the base 106, but this is not limiting. For example, the sloped walls of the cone may slope towards an off-center position, closer to the dispensing aperture 116. The insert 108 may be releasably mounted onto the base 106 by simply resting on the floor 162 of the base 106. However, the insert's 108 top outer rim may rest upon a top edge of the side wall 160 of the base 106. Alternatively, the insert 108 may be releasably mounted by snapping or twisting via threading so that when the base 106 is turned upside down, the insert remains locked in place until it is unsnapped or twisted for release. Releasable mountings facilitate cleaning of the insert 108, e.g., in the event of liquid spillage, and minimize/prevent spills from contaminating the base 106.

Figure 7:
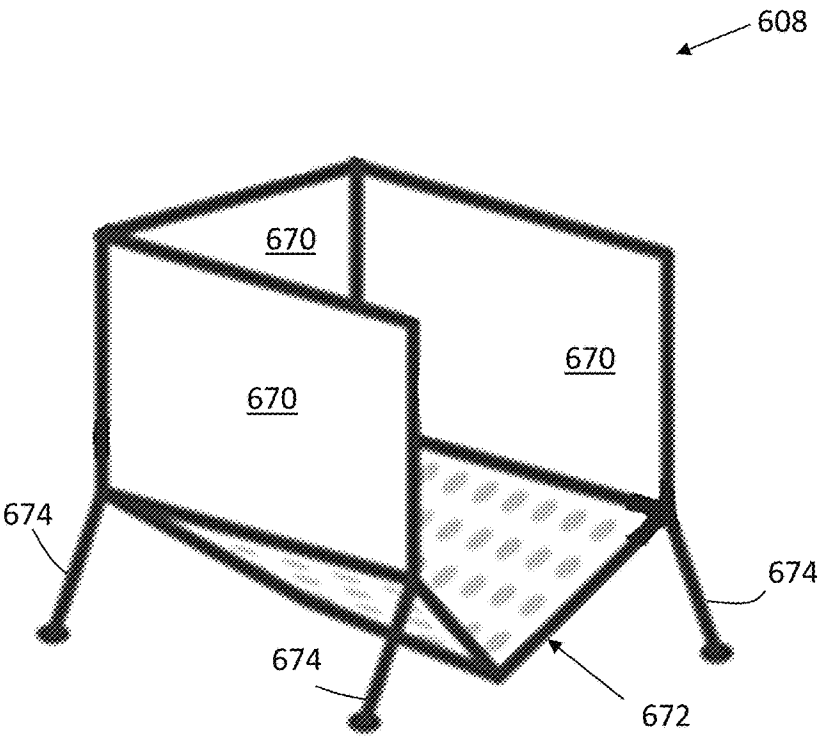
FIG. 7 shows a perspective view of an insert of the system of FIGS. 6A-6C.

Another embodiment of an insert is shown in FIGS. 6A-6B and 7. As best shown in FIG. 7 (showing a perspective view of the insert 608), the insert 608 includes side walls 670 mounted to a bottom plate 672. The bottom plate 672 is sloped such that an edge of the bottom plate 672 proximate the dispensing aperture 616 of the base 606 is lower and an opposing edge is higher. This way, liquid within the refill container 604 resting on the sloped bottom plate 672 will flow towards and pool next to the dispensing aperture 616. In this embodiment, the bottom plate 672 is formed from two sloped plates, forming a V-shaped cross-section. The bottom plate 672 is also perforated, although this is not necessary. The insert 608 includes a plurality of legs 674 mounted to the bottom plate 672/side walls 670 to support the insert 608 within the base 606 (e.g., on a floor 676 of the base 606). The floor 676 may have indentations to receive portions of the insert 608 (e.g., the legs 674 and/or the sloped bottom plate 672) to facilitate holding the insert 608 in place.

In general, the shape and dimensions of the wall(s) and the plate(s) of an insert are not particularly limited, but depend upon the configuration of a housing, a base and a refill container.

Pump Assembly

Figure 9:
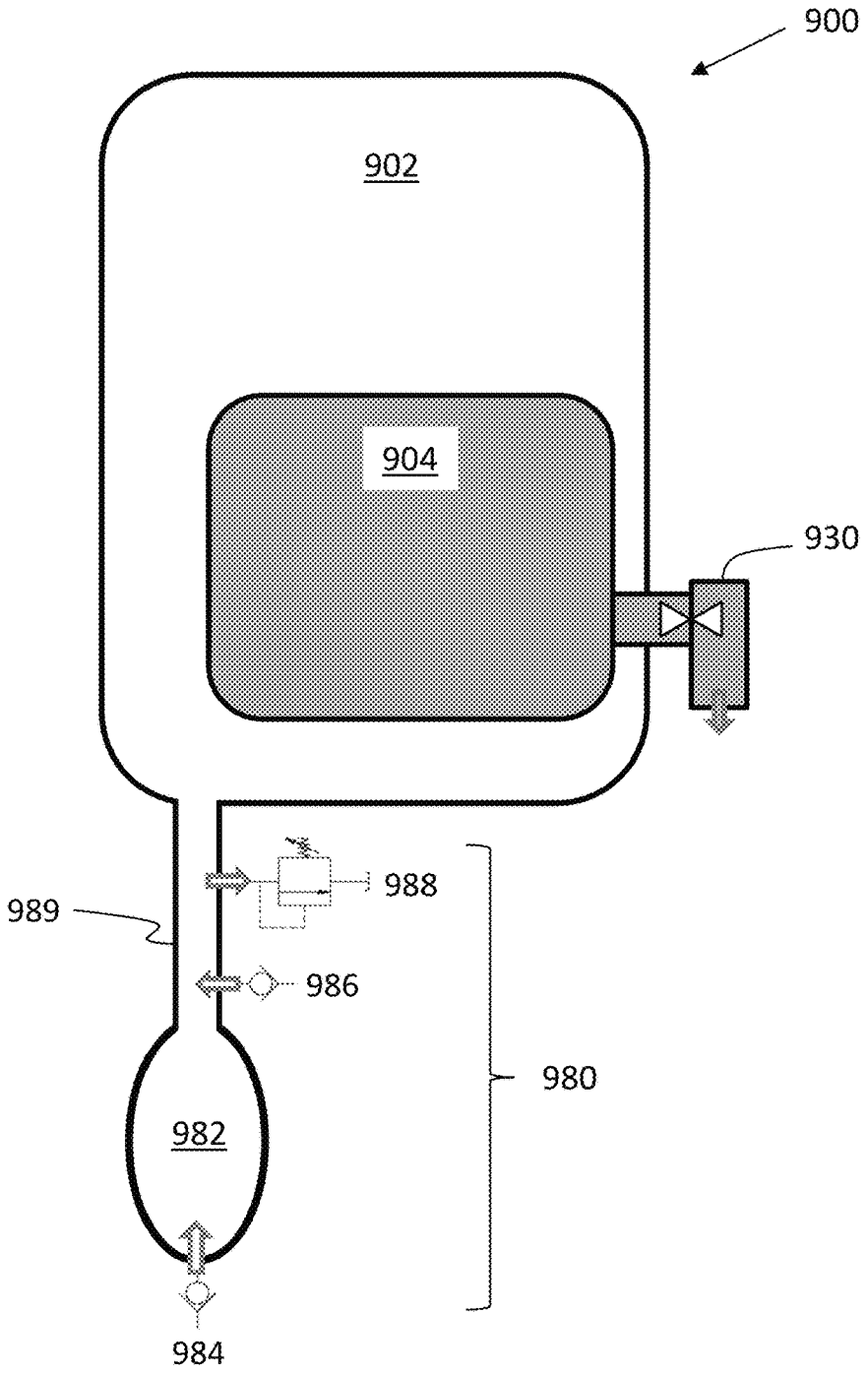
FIG. 9 is a schematic illustrating a liquid dispensing system according to another illustrative embodiment.

FIG. 9 is a schematic illustrating a liquid dispensing system 900 which includes a housing 902, a refill container 904, and a pump assembly 980. The pump assembly 980 is in fluid communication with the housing 902 and is configured to deliver a gas to the interior of the housing 902. The gas applies a uniform pressure on the surface of the refill container 904. This facilitates the removal of the liquid within the refill container 904 through a spout 930, e.g., as a user presses a button on the spout 930, more liquid is dispensed more quickly through the spout than would be dispensed in the absence of the gas/pressure. The housing 902 and the refill container 904 may assume any of the configurations described herein. In addition, the system 900 may include various combinations of the additional components described herein.

With respect to the pump assembly 980, it includes a gas source 982 (e.g., air). The gas source 982 may be provided by a variety of components, e.g., a pump (e.g., hand pump, foot pump, baffle pump, etc.), a compressor, a fan, etc. Any of these illustrative components may be manually operated or operated under electrical or battery control. The pump assembly 980 further includes valves, e.g., a check valve 984 for the gas source 982, a check valve 986 for the system 900, and a relief valve 988 for the system 900. The gas source 982 is in fluid communication with the housing 902 via a fluid pathway 989 (e.g., one or more tubes). During use, gas (e.g., air) provided by the gas source 982 fills the interior of the housing 902, thereby applying a uniform pressure on the refill container 904. This pressure forces out liquid in the refill container 904 through the spout 930 when the spout 930 is opened. This facilitates removal of all of the liquid in the refill container 904, which reduces waste and lowers costs, and creates a faster flowrate of the liquid. The amount of pressure provided by the gas depends upon how much gas is introduced to the system. Relief valves can be selected so as to let out gas from the interior of the housing 902 if the pressure goes above a predetermined value.

Figure 10B:
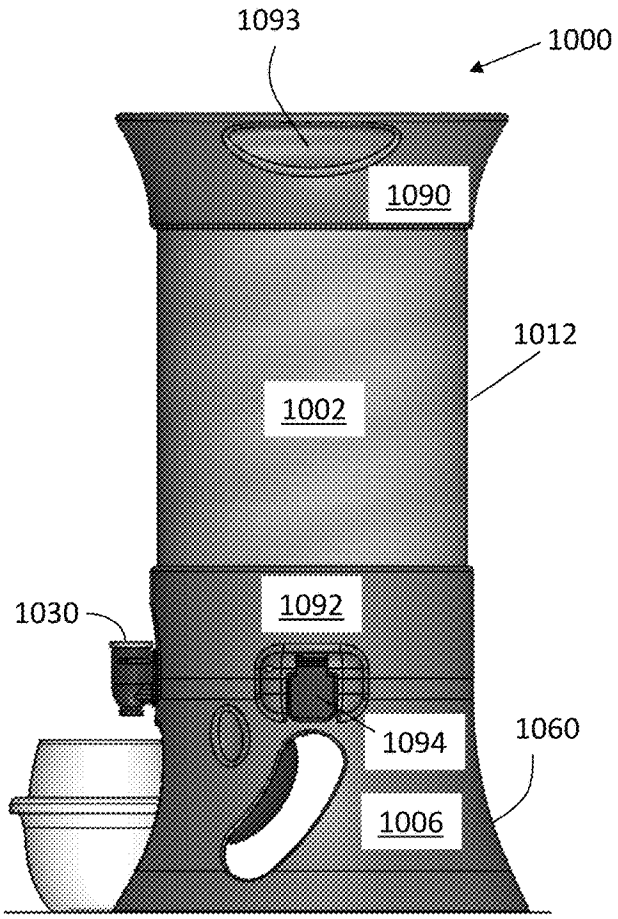
FIG. 10B is a side view of the system.
Figure 10A:
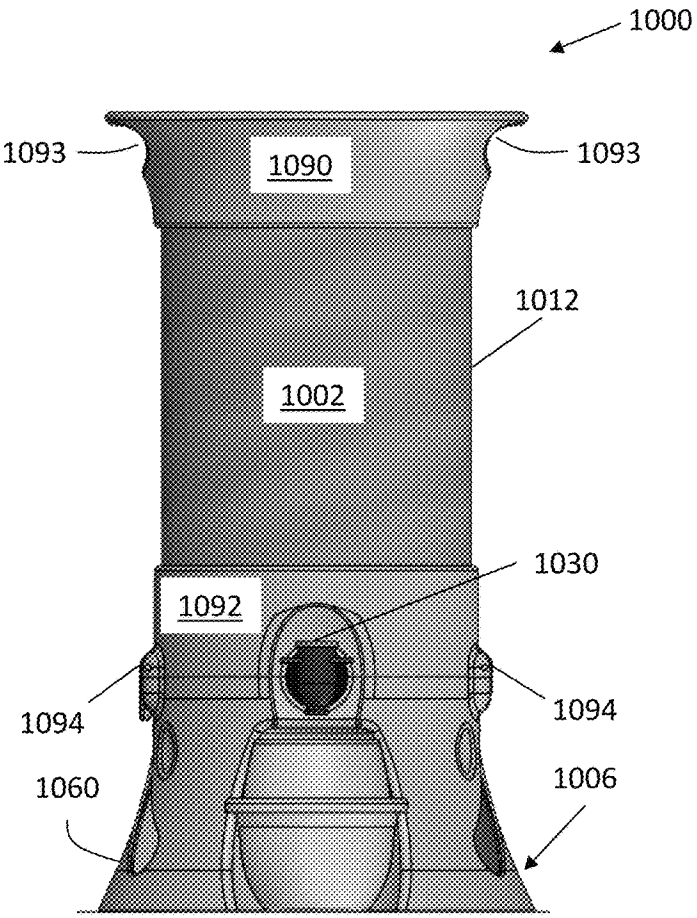
FIG. 10A is a front view of a liquid dispensing system according to another illustrative embodiment.
Figure 10C:
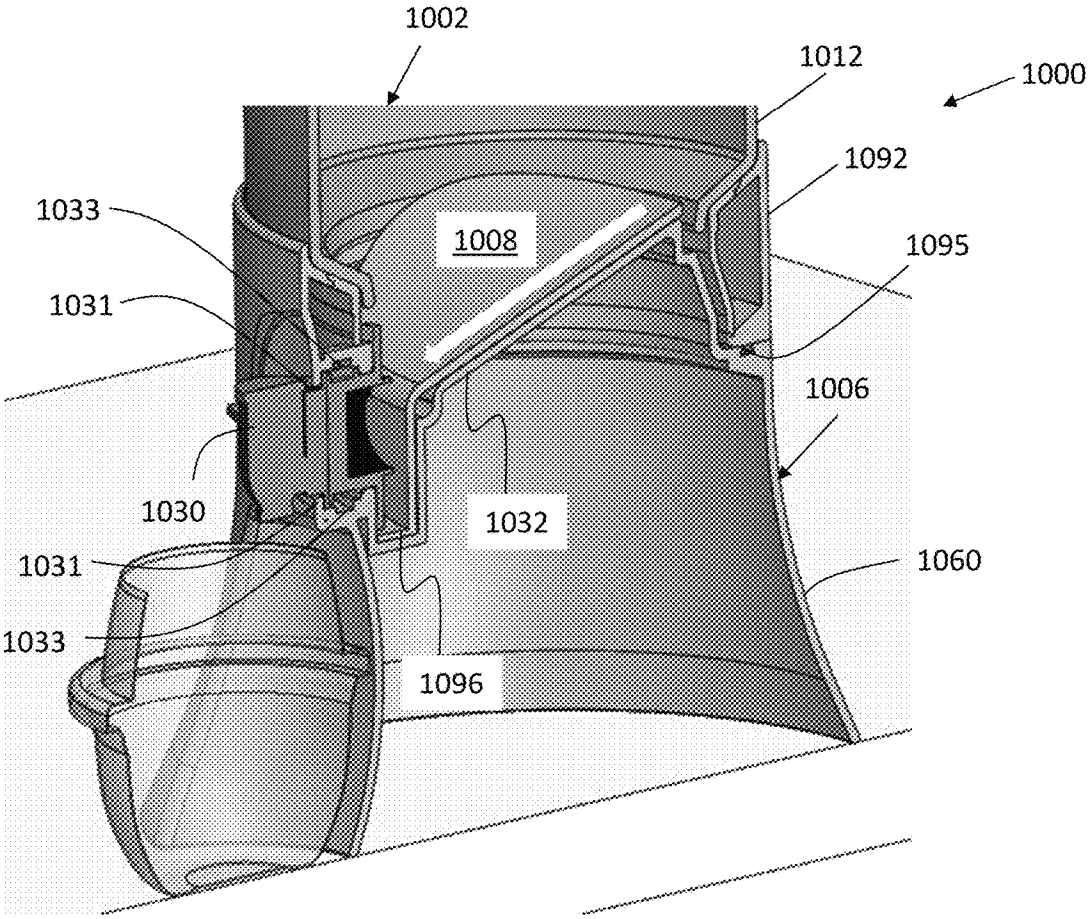
FIG. 10C is a perspective, cross-sectional view of the system.
Figure 10D:
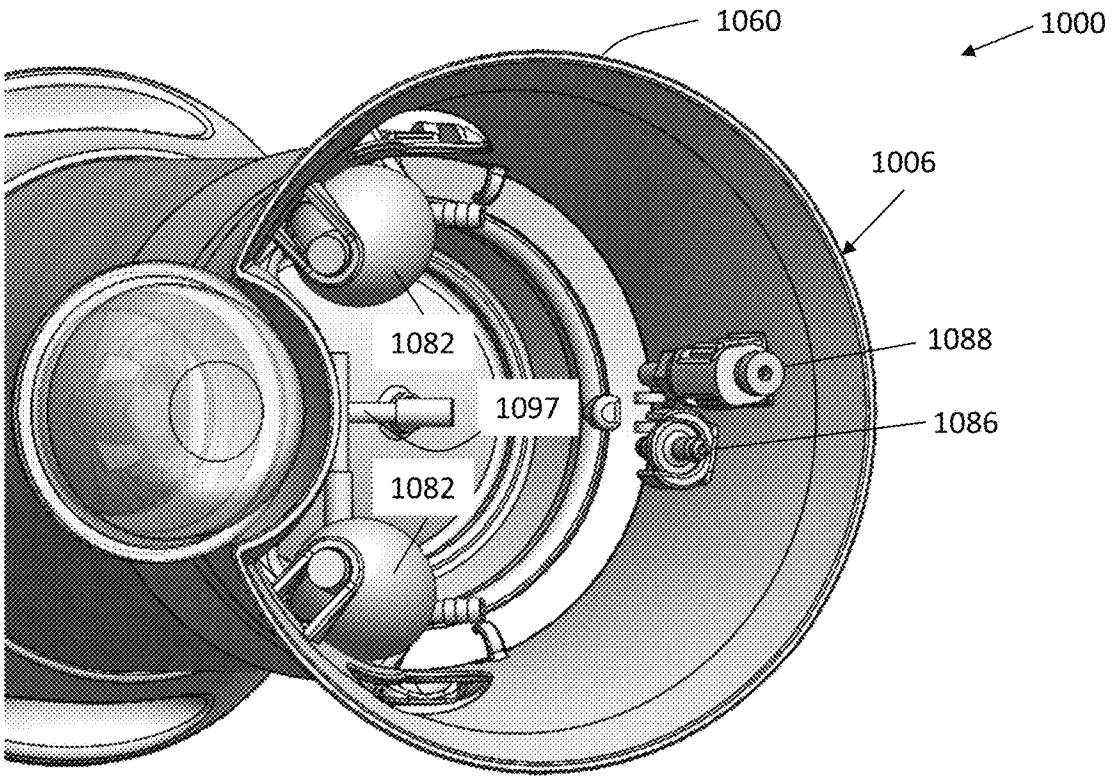
FIGS. 10D and 10E are tilted views of the underside of the system.
Figure 10E:
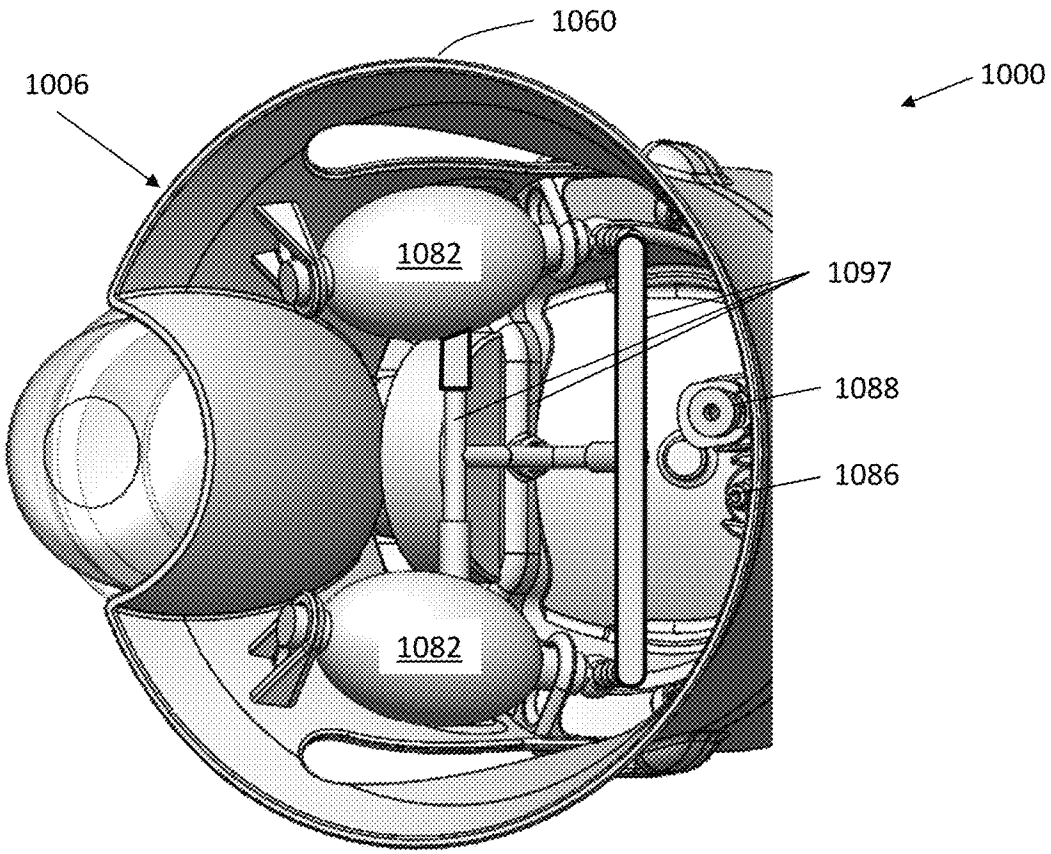

FIGS. 10A-10E show an embodiment of an illustrative liquid dispensing system 1000. FIG. 10A is a front view of the system 1000. FIG. 10B is a side view of the system 1000. FIG. 10C is a perspective, cross-sectional view of the system 1000. FIGS. 10D and 10E are tilted views of the underside of the system 1000.

The system 1000 includes a housing 1002, a base 1006, an insert 1008, and a pump assembly. Also shown in these figures is a drinking vessel for receiving liquid dispensed from the system 1000.

The housing 1002 is an insulated housing including a top double wall (not shown) and a side double wall 1012 shaped as a cylinder. The cylinder defines an interior for receiving a refill container (only a spout 1030 of the refill container is shown). A cap 1090 is mounted to the housing at its top end in which depressions 1093 are formed, providing gripping surfaces for a user. A collar 1092 is mounted to the housing at its bottom end. The collar 1092 has a semi-circular dispensing aperture formed therein for receiving the spout 1030. Hinged tabs 1094 for mounting the housing 1002 to the base 1006 are also mounted on the collar 1092. It is to be understood that both the cap 1090 and the collar 1092 may be considered to be part of the housing 1002.

The base 1006 includes a side wall 1060 which is also cylindrical in shape although its walls are slightly curved. A semi-circular aperture is formed in the side wall 1060 to receive a portion of the spout 1030. As best shown in FIG. 10C, the base 1006 also includes a raised, sloped floor 1032 which is mounted to the side wall 1060 of the base 1006. This way, the floor 1032 elevates a refill container resting thereon into the interior of the insulated housing 1002. In addition, the floor 1032 facilitates the flow and pooling of the liquid in the refill container towards the spout 1030. The base 1006 further includes complementary shaped projections to mate with (e.g., via snapping) the hinged tabs 1094 of the collar 1092. Although not shown in FIG. 10C, the base 1006 may include an additional floor mounted under the floor 1032 to form a compartment which may be filled with an insulating material to provide for additional insulation. A gasket or ring may be used at a mounting interface between the collar 1092 and the base 1006 to provide a gas-tight seal when mounted together. Such a gasket or ring may be inserted into a groove 1095 on either the collar 1092, the base 1006, or both. The phrase "gas-tight seal" can mean, but does not necessarily mean, that no gas can pass from the interior of the housing 1002 (when mounted to the base 1006) to the exterior through the sealed mounting interface. However, the phrase means that enough gas is prevented from passing so that the gas pumped into the interior of the housing 1002 can apply pressure to the refill container 904 to facilitate dispensing of the liquid as described above. In embodiments, the phrase "gas-tight seal" means that a predetermined amount of gas pumped into the interior of a housing (e.g., the amount of air provided by 3 to 10 or 3 to 7 or 3 to 5 presses of the hand pumps of the pumping assembly of FIGS. 10A-10E and 11A-11B) followed by immediately dispensing the liquid within a refill container mounted within the housing is sufficient to remove liquid (e.g., from about 2 ounces to 8 ounces or 3 ounces to 7 ounces or 4 ounces to 6 ounces of liquid) from the refill container and/or to increase the flow rate of the liquid being dispensed.

The insert 1008 includes a sloped plate portion which rests upon and conforms to the surface of the floor 1032 of the base 1006. In this embodiment, both sloped plate portion of the insert 1008 and the floor 1032 are slightly curved in that opposing side edges of the sloped plate portion and the floor 1032 are slightly higher than the centers of each. The resulting shape of the sloped plate portion and the floor 1032 is that of a slightly folded tortilla shell. In this way, a channel is formed that extends from a back edge of the sloped plate portion/floor 1032 to an opposing edge and funnels liquid in the refill container towards the spout 1030. The channel and flow direction from back towards front are indicated with an arrow in FIG. 10C. The insert 1008 simply rests upon the floor 1032 and thus, it is readily removable from the base 1006. The insert 1008 includes a ledge portion 1096 which extends downwardly from the sloped plate portion and fits into a groove formed between the side wall 1060 of the base 1006 and its raised, sloped floor 1032. This way, the insert 1008 covers most of the underlying surface of the base 1006, which is useful for collecting any spilled liquid, facilitating cleaning, and minimizing/preventing contamination of the base 1006 from spills.

FIGS. 10D and 10E best illustrate the pump assembly. The pump assembly includes two hand pumps 1082, providing a source of air. The hand pumps 1082 are in fluid communication with the interior of the housing 1002 via tubing 1097. For clarity, not all of the tubing 1097 is shown in FIG. 10D. The tubing 1097 terminates at an opening formed in the base 1006 so that the air can fill the interior of the housing 1002 (when the base 1006 is mounted to the housing 1002). This is best illustrated in the expanded section A of FIG. 11A. The pump assembly also includes a system check valve 1086 and a system relief valve 1088. The hand pumps 1082 are mounted against approximately opposing interior sides of the side wall 1060 of the base 1006 and are accessible via apertures formed therein. (See FIGS. 10B and 10E.) These apertures are shaped to allow a user's fingers to grab each hand pump 1082 and manually depress it to pump air into the housing 1002. Depressions on approximately opposing exterior sides of the side wall 1060 of the base 1006 fit a user's thumbs to further facilitate depression/pumping. (See FIGS. 10A, 10B.)

Thus, the illustrative liquid dispensing system 1000 shown in FIGS. 10A-10E may be described as comprising insulated housing 1002 comprising a top wall and side wall 1012 mounted to the top wall, side wall 1012 extending downwardly from the top wall to define an interior configured to receive a refill container comprising a liquid, insulated housing 1002 open at an end opposite the top wall; base 1006 mounted to the open end of housing 1002 opposite the top wall at a first mounting interface which forms a gas-tight seal (see FIG. 12C and groove 1095), base 1006 comprising side wall 1060 extending downwardly from side wall 1012 of housing 1002 and floor 1032 mounted to side wall 1060 of base 1006, floor 1032 configured to enclose the interior of housing 1002; a sloped surface (floor 1032 and/or separate insert 1008) mounted within the interior of housing 1002 and configured to induce the liquid within the refill container to flow toward dispensing aperture 1031 configured to receive spout 1030 of the refill container at a second mounting interface which forms another gas-tight seal (see groove 1033) through which spout 1030 the liquid is dispensed from the system 1000; and a pump assembly in fluid communication with the interior of housing 1002, the pump assembly comprising a gas source and configured to deliver a gas from the gas source to the interior of housing 1002 to apply pressure to the refill container. In this embodiment, side wall 1012 of housing 1002 and side wall 1060 of base 1006 together define dispensing aperture 1031, and the second mounting interface extends from the first mounting interface. The extension of the second mounting interface from the first mounting interface is best visualized in FIG. 10C as groove 1095 (associated with the first mounting surface) intersects with groove 1033 (associated with the second mounting surface) behind spout 1030 which extends through dispensing aperture 1031.

Figures 11A, 11B:
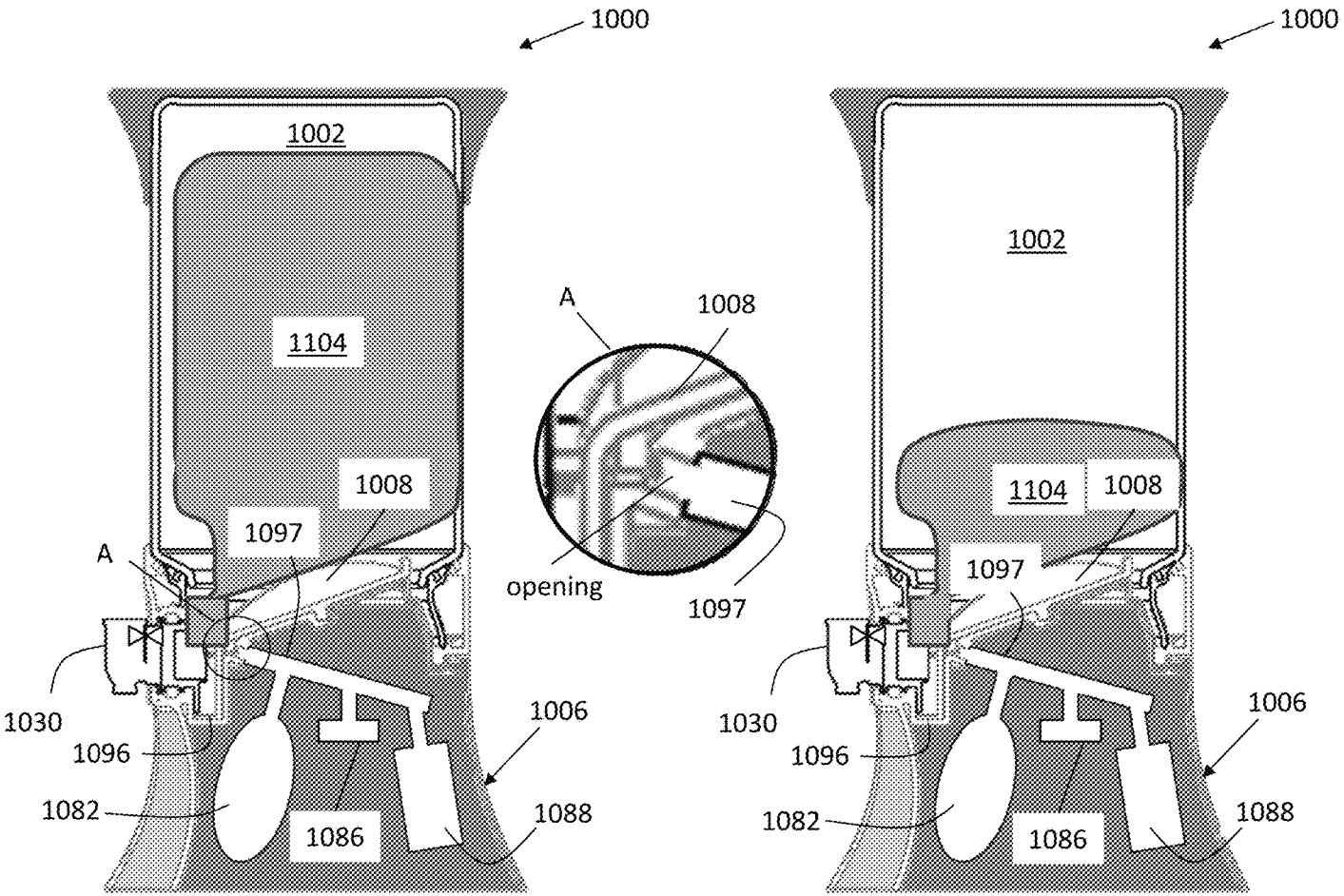
FIGS. 11A and 11B show cross-sectional, side views of the system of FIGS. 10A-10E during use.

Operation of the system 1000 is illustrated in FIGS. 11A and 11B. FIG. 11A shows a cross-sectional side view of the system 1000 with the schematic of a filled refill container 1104 placed within the interior of the housing 1002. Liquid from the refill container 1104 may be periodically dispensed through the spout 1030 by a user. When the liquid is nearly gone, as shown in the cross-sectional side view of FIG. 11B, the user may depress the hand pumps 1082 to fill the interior of the housing 1002 with air, thereby applying uniform pressure to the refill container 1104. This forces the remaining liquid out of the refill container 1104 upon further dispensing through the spout 1030.

Figure 12A:
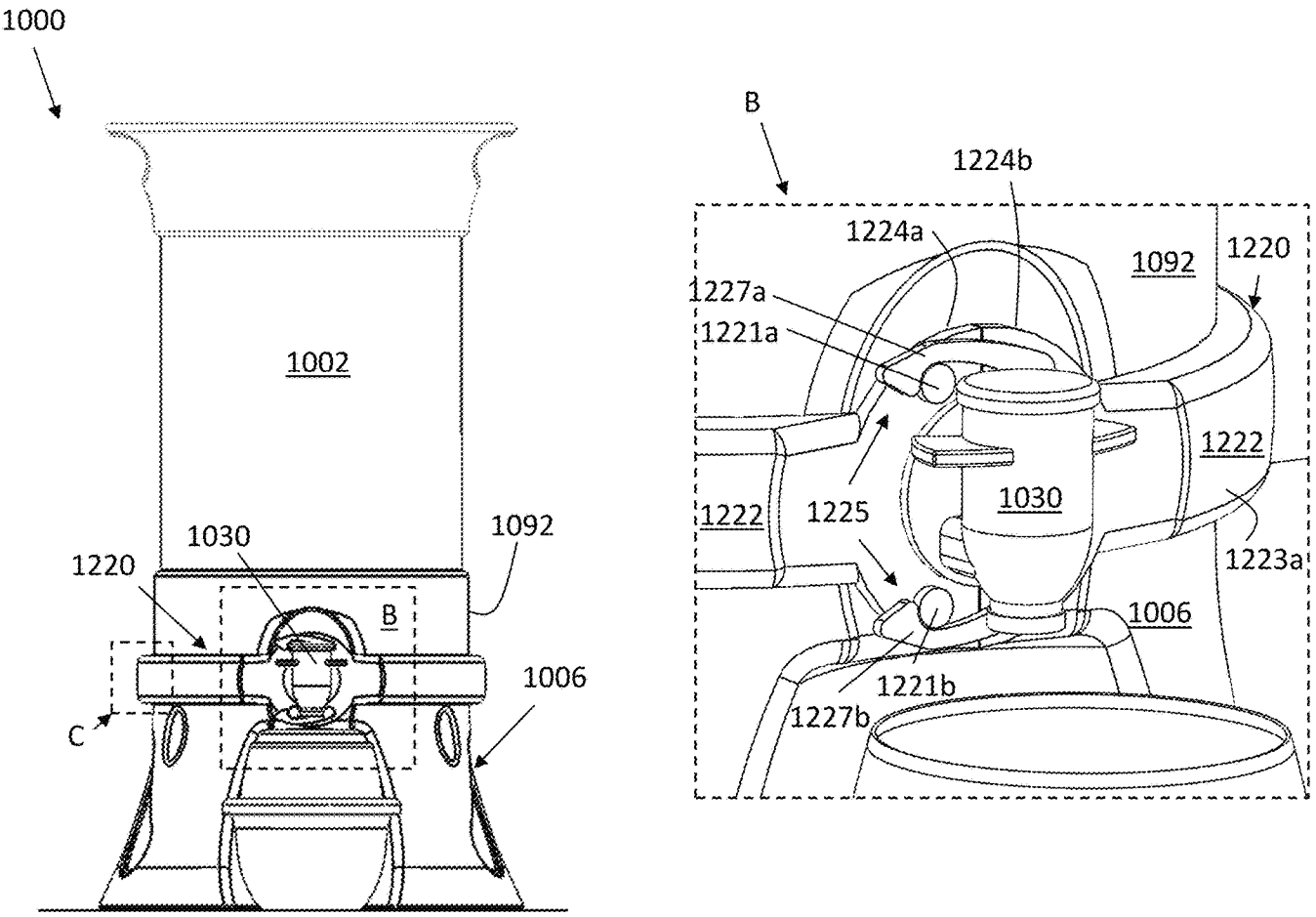
FIG. 12A shows a front view of the system of FIG. 10A, but using an alternative belt mounting according to an illustrative embodiment.
Figure 12B:
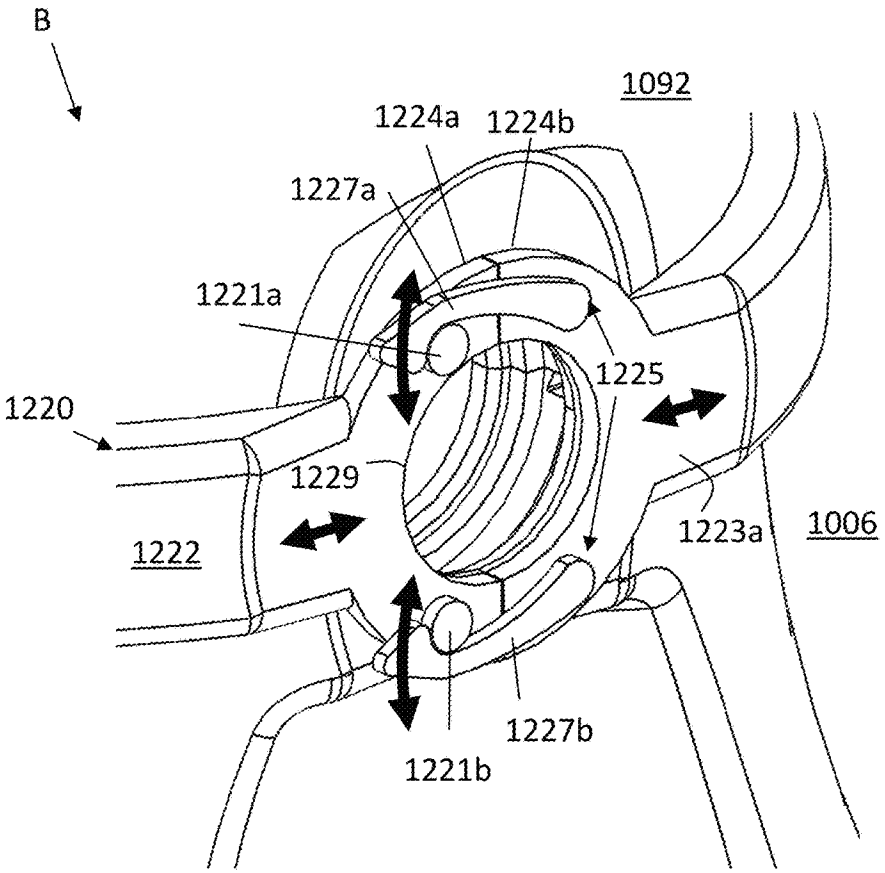
FIG. 12B shows a view of section B of FIG. 12A, but without the spout.
Figure 12C:
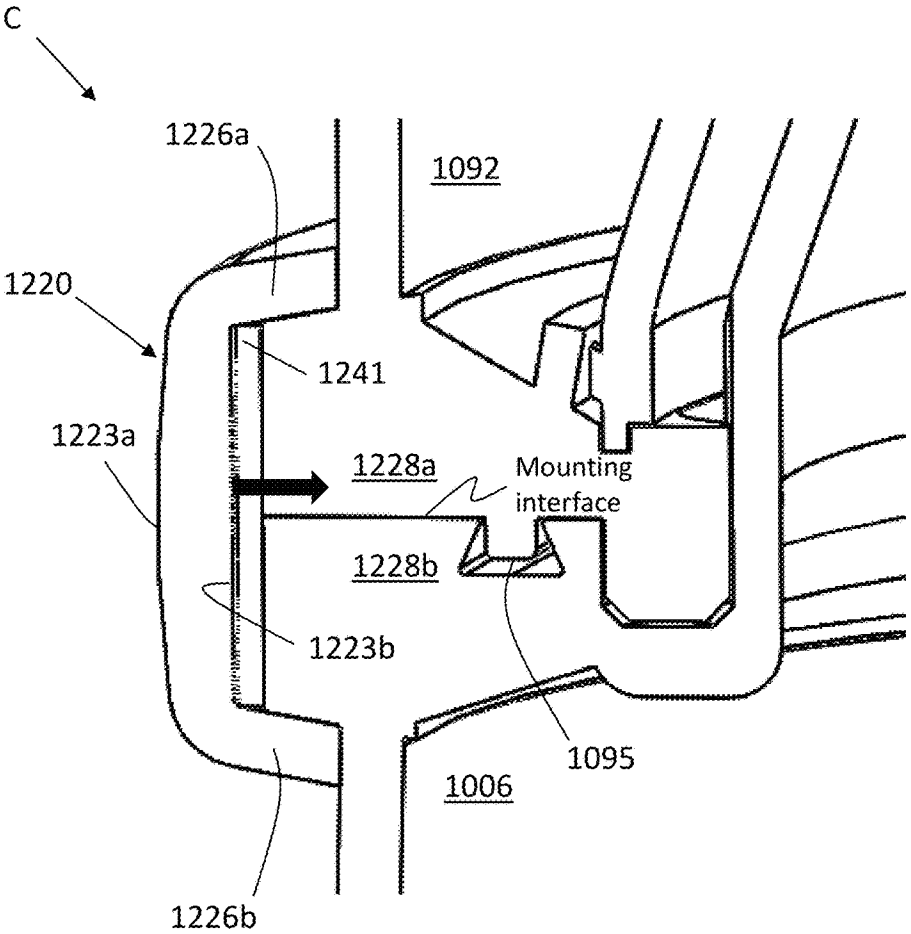
FIG. 12C shows a cross-sectional view of section C of FIG. 12A.
Figures 13A, 13B:
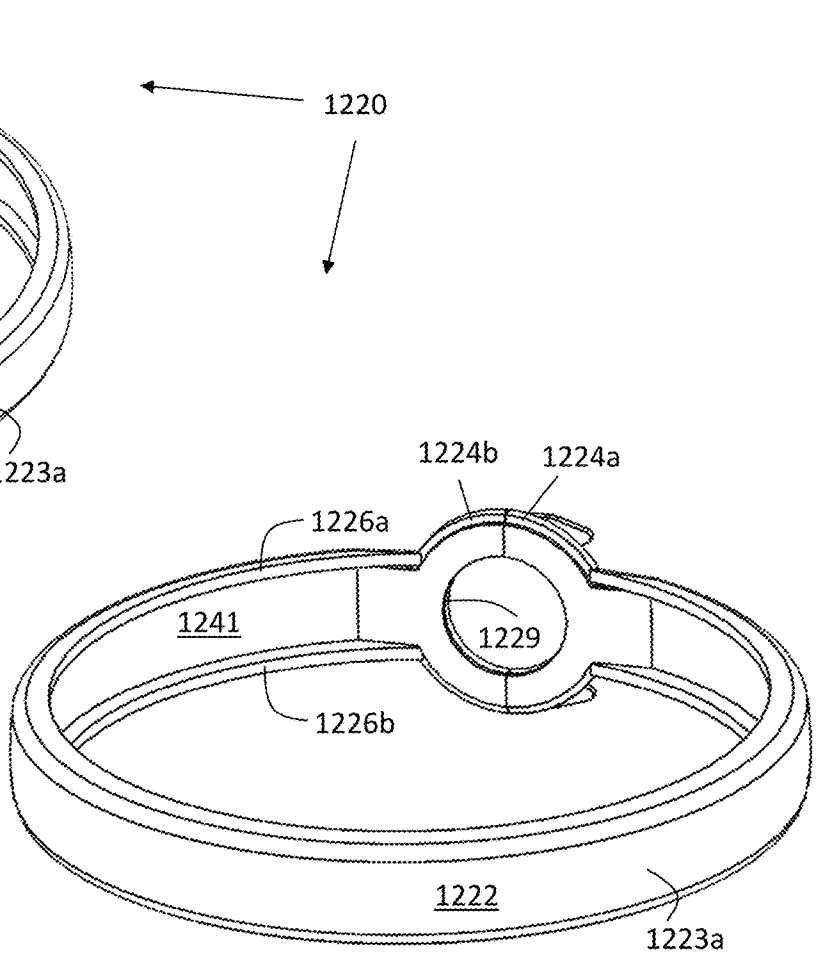
FIG. 13A shows a front, perspective view of a belt for mounting a housing to a base according to an illustrative embodiment.
FIG. 13B shows a back, perspective view of the belt.

FIGS. 12A-12C show the system 1000 of FIGS. 10A-10E, but using a different technique to mount the housing 1002 to the base 1006, a mounting technique which includes the use of a belt 1220. FIG. 12A shows a front view of the system 1000, along with an expanded, perspective view of section B. FIG. 12B shows a section B, but without the spout 1030 (mounted to a refill container, not shown). FIG. 12C shows a front, cross-sectional view of a section C. FIG. 13A shows a front, perspective view of the belt 1220. FIG. 13B shows a back, perspective view of the belt 1220. The mounting shown in these figures is useful for providing a gas-tight seal as described above.

The belt 1220 is configured to provide a gas-tight seal between the housing 1002 and the base 1006 when these two components are mounted together as described above. Specifically, the belt 1220 is configured to apply an inward pressure on surfaces to which the belt 1220 contacts, i.e., outer surfaces of the housing 1002 and the base 1006. This inward pressure, i.e., towards the center of the system 1000, is indicated with an arrow in FIG. 12C. The belt 1220 is also configured to prevent/minimize separation of the housing 1002 and the base 1006, i.e., at their mounting interface, when the interior of the housing 1002 is filled with gas and under pressure.

The belt 1220 includes an elongated portion 1222 having an outer side surface 1223*a*, an inner side surface 1223*b*, top and bottom surfaces, and opposing ends 1224*a, b*. The belt 1220 further includes a buckle portion 1225. The elongated portion 1222 is configured to extend around the perimeters of the housing 1002 and the base 1006 and around their mounting interface. As shown in FIG. 12C, the belt 1220 may include upper and lower ledges 1226*a, b* extending from the top and bottom surfaces of the elongated portion 1222 to define a c-shaped cross-section. This way, ridges 1228*a, b* mounted to the housing 1002 and the base 1006, respectively, can fit into the recess formed by the c-shape of the elongated portion 1222, against the inner side surface 1223*b*. When opposing ends 1224*a, b* of the elongated portion 1222 are brought together via the buckle portion 1225, the belt 1220 applies an inward pressure and prevents/minimizes separation of the housing 1002 and the base 1006 as described above.

As noted above, the buckle portion 1225 is configured to bring together opposing ends 1224*a, b* of the elongated portion 1222 together so that the elongated portion 1222 conforms to the outer surfaces of the housing 1002 and the base 1006. In this embodiment, the buckle portion 1225 includes upper and lower pegs 1221*a, b* projecting from the outer side surface 1223*a* of the elongated portion 1222 and upper and lower pivotable hooks 1227*a, b*, which fit around a portion of the upper and lower pegs 1221*a, b*, respectively. The upper/lower pegs 1221*a, b* are mounted to one end 1224*a* of the elongated portion 1222 while the upper/lower pivotable hooks 1227*a, b* are mounted to the opposing end 1224*b* of the elongated portion 1222.

The belt 1220 also defines an aperture 1229 through which the spout 1030 may be inserted. In this embodiment, the aperture 1229 is formed by having opposing ends 1224*a, b* of the elongated portion 1222 shaped as semi-circles (which, when brought together, form a circle). Operation of the belt 1220 is illustrated in FIG. 12B via the arrows. The approximately vertical arrows illustrate the movement of the pivotable hooks 1227*a, b* as well as how they fit around portions of the upper and lower pegs 1221*a, b*, respectively. The approximately horizontal arrows illustrate the movement of the opposing ends 1224*a, b* of the elongated portion 1222.

The belt 1220 further comprises a gasket 1241 which fits in the recess of the c-shaped defined by the elongated portion 1222 and the upper and lower ledges 1226*a, b*. The gasket 1241 further facilitates the formation of the gas-tight seal.

It is to be understood that various configurations may be used for the belt 1220, e.g., the elongated portion 1222 may assume different shapes and dimensions and the buckle portion 1225 may include different, additional, or fewer components, provided the belt has the functionalities described above. However, for cylindrically shaped housings and bases, the belt 1220 and its elongated portion 1222 will generally be circular in shape.

Figure 14:
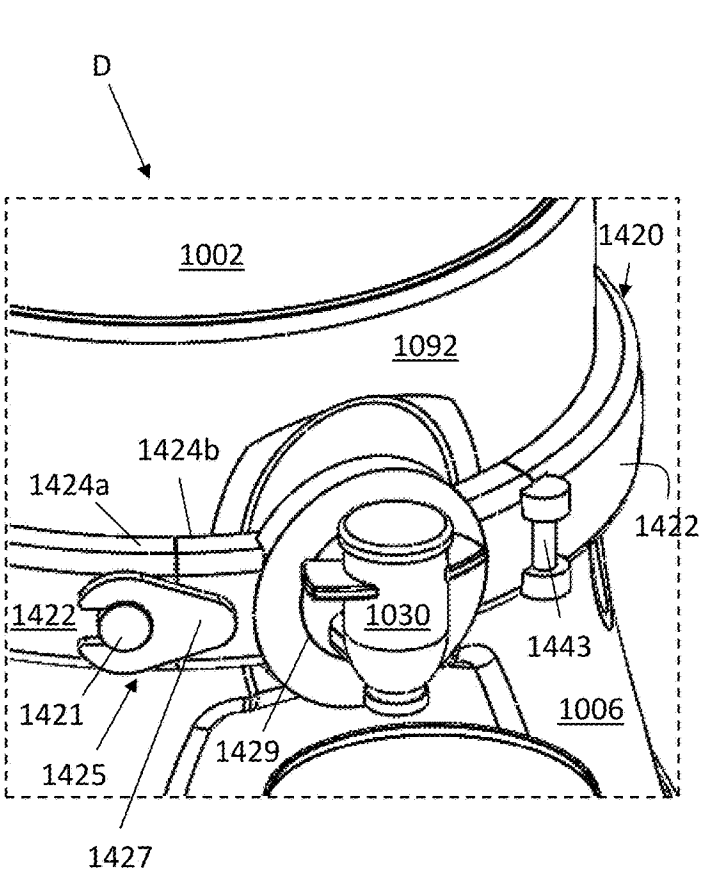
FIG. 14 shows a front view of the system of FIG. 10A, but using an alternative belt mounting according to an illustrative embodiment.
Figure 14:
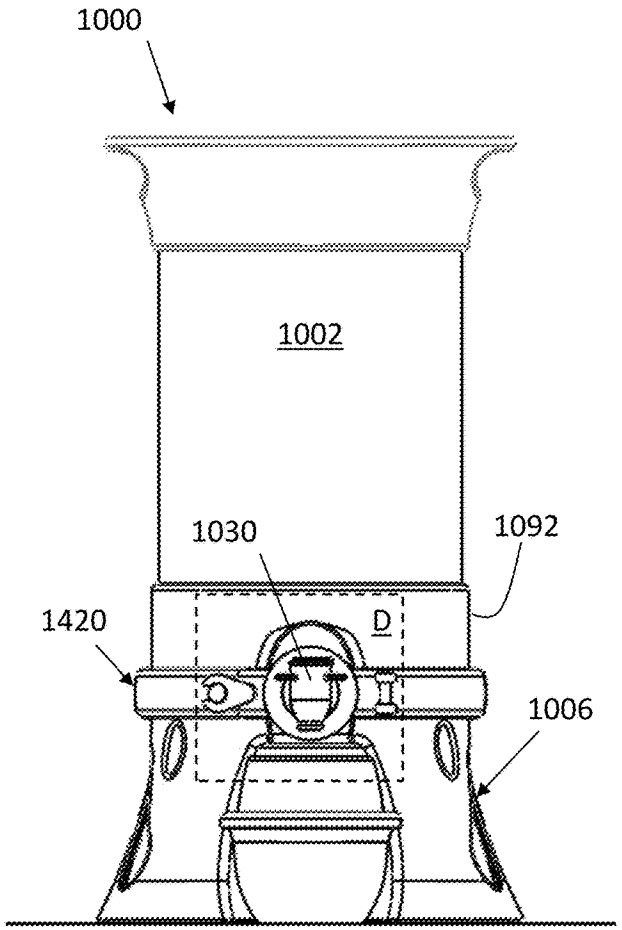
Figures 15A, 15B:
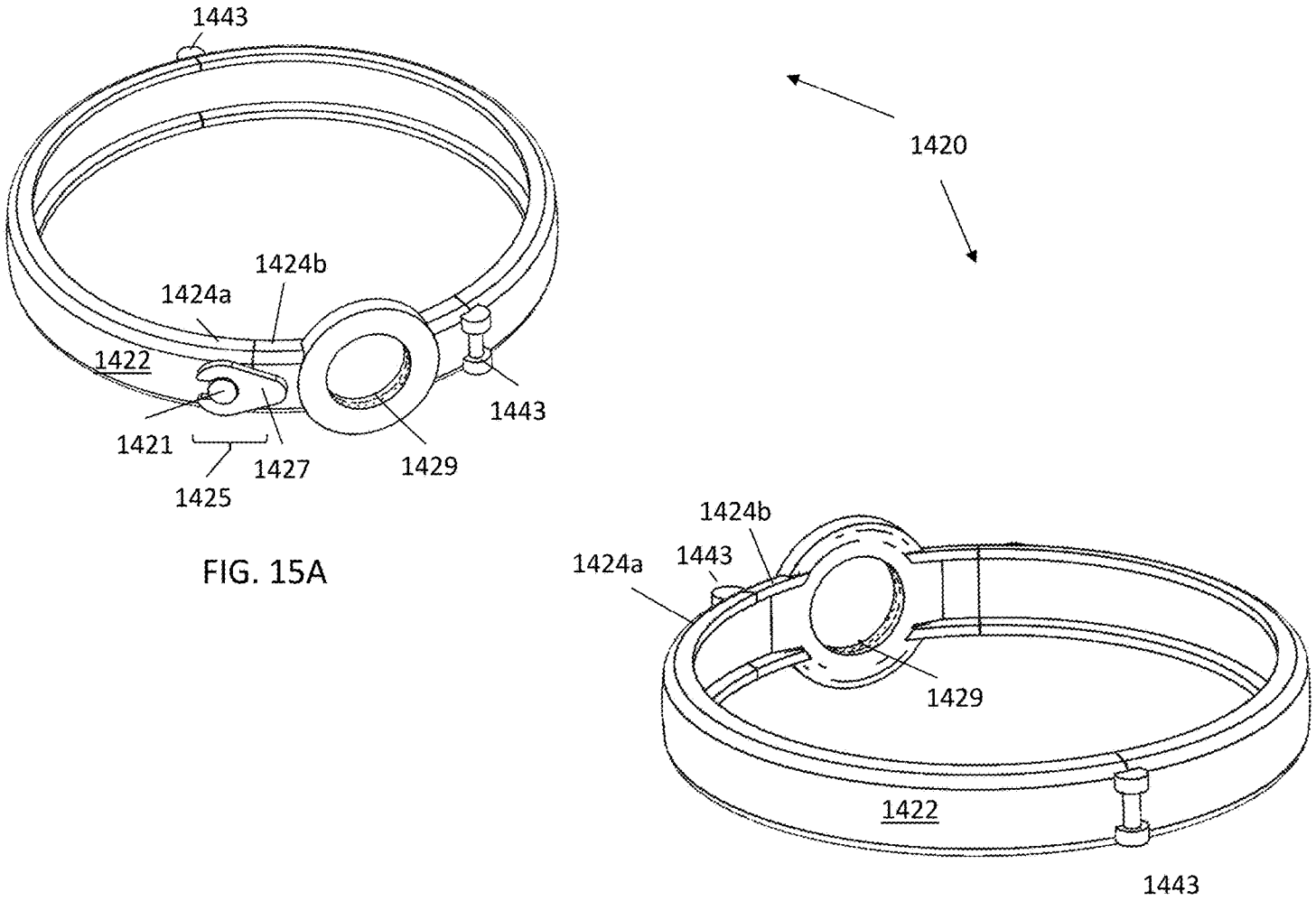
FIG. 15A shows a front, perspective view of a belt for mounting a housing to a base according to an illustrative embodiment.
FIG. 15B shows a back, perspective view of the belt of FIG. 15A.

Another illustrative belt-based mounting is shown in FIG. 14 and FIGS. 15A-15B. FIG. 14 shows the system 1000 of FIGS. 10A-10E, but which includes the use of a belt 1420 to mount the housing 1002 to the base 1006. FIG. 14 shows a front view of the system 1000, along with an expanded, perspective view of section D. FIG. 15A shows a front, perspective view of the belt 1420. FIG. 15B shows a back, perspective view of the belt 1420.

The belt 1420 is configured similarly to the belt 1220 in that it includes an elongated portion 1422 with opposing ends 1424*a, b* and a buckle portion 1425. However, in this embodiment, the buckle portion 1425 includes a single peg 1421 and a single pivotable hook 1427. Also, an aperture 1429 is formed along the length of the elongated portion 1422 (rather than at opposing ends) and two hinges 1443 are included in the belt 1420 to facilitate fitting the belt onto the housing 1002 and the base 1006. Regarding the two hinges 1443, one hinge or more than two hinges may be used. One or more hinges may also be used with the belt 1220. Hinges may be placed anywhere along the length of the elongated portion 1422 (or 1222).

It is to be understood that in the description of the belts above, references to a housing may instead refer to a collar mounted thereon.

Figure 16:
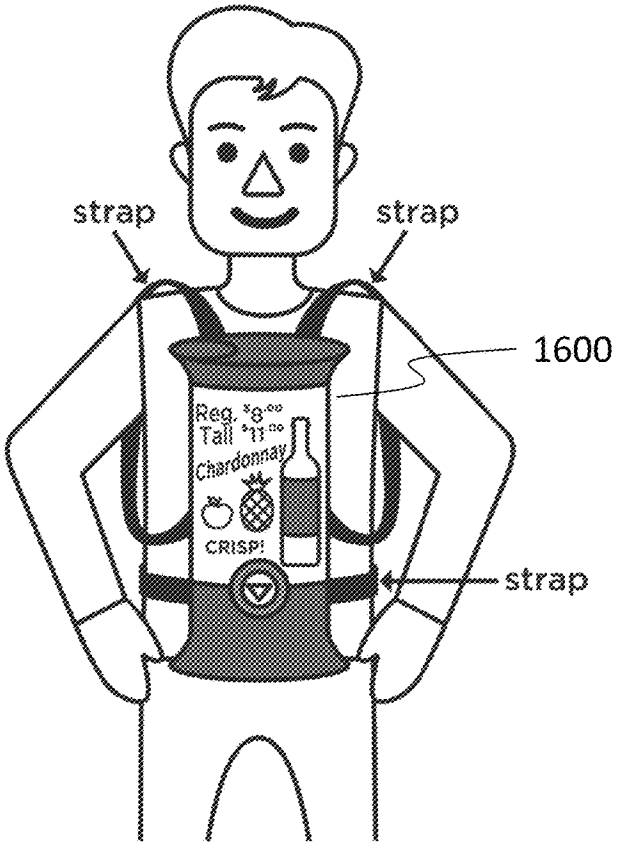
FIG. 16 illustrates a user holding a liquid dispensing system according to an illustrative embodiment.

As illustrated in FIG. 16, any of the disclosed liquid dispensing systems (such as liquid dispensing system 1600) may further comprise a carrying case configured to accommodate the system and to be carried by a user (e.g., over a shoulder, a chest, a back, etc.).

Although not shown, any of the outer surfaces of the disclosed liquid dispensing systems, e.g., housing, base, etc. may be labeled with permanent or removable decorations, words, and images (e.g., via adhesive or magnetic mounting).

Although the liquid dispensing systems described above focused on a single housing, a system may comprise a plurality of housings. Similarly, although the liquid dispensing systems described above focused on a single refill container within a housing, the housing may comprise a plurality of refill containers.

Unless otherwise specified, the materials used for the components of the disclosed liquid dispensing system are not particularly limited, but rather may be selected according to the intended function of the components. However, in embodiments, the housing and the base are not composed of cardboard or paper or a material functionally equivalent to cardboard or paper. Rather, rigid polymers, plastic, or metal may be used to form the housing and the base (as well as other components of the liquid dispensing system). The present liquid dispensing systems are not configured as a single-use product. Rather, the liquid dispensing systems are configured for multiple use, upon refilling the refill container or inserting a new refill container.

Liquid dispensing systems according to the present disclosure may include various combinations of the components, features and functionalities described above, without limitation.

Some features referenced above but not shown and other features not referenced or shown have been described in U.S. Provisional Patent Application 62/545,590, filed Aug. 15, 2017, which is hereby incorporated by reference in its entirety. Any of these may be included in the present liquid dispensing systems without limitation.

It is to be understood that the refill containers themselves are also encompassed by the present disclosure, as well as methods of using the refill containers and the liquid dispensing systems.

It is to be understood that the present disclosure encompasses the liquid dispensing systems themselves, i.e., absent the refill containers.

At least some embodiments of the present liquid dispensing systems may be characterized by one or more of the following advantages: reducing the cost of beverage to consumers by reducing cost of packaging supplies, shipping weights, storage needed, and loss of product; increase efficiency by removing many of the steps needed for conventional beverage delivery and increasing the size of the product so fewer steps needed to be done and are performed less often; maintain freshness of the beverage by design and packaging supplies that reduce exposure to oxygen; maintain an ideal temperature of the beverage by allowing the user to preserve the temperature of the beverage, should it be cooler than the ambient air or chill the beverage without watering down the beverage by adding ice and even in the absence of access to electricity; and reduce waste since wine dispensing by way of the refill containers uses much less packaging material when compared to bottles and single-serving dispensing units.

Unless otherwise specified, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or thermoforming process. As a result, elements described herein as being mounted to each other need not be discrete structural elements. The elements may be mounted permanently, removably, or releasably unless specified otherwise.

Use of directional terms, such as top, bottom, right, left, front, back, etc. are merely intended to facilitate reference to various surfaces that form components of the devices referenced herein and are not intended to be limiting in any manner.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more."

The foregoing description of illustrative embodiments of the present disclosure has been presented for purposes of illustration and of description. It is not intended to be exhaustive or to limit the disclosure to the precise form disclosed, and modifications and variations are possible in light of the above teachings or may be acquired from practice of the disclosure. The embodiments were chosen and described in order to explain the principles of the disclosure and as practical applications of the disclosure to enable one skilled in the art to utilize the disclosure in various embodiments and with various modifications as suited to the particular use contemplated. It is intended that the scope of the disclosure be defined by the claims appended hereto and their equivalents.

What is claimed is:

1. A dispensing system for dispensing a liquid, the system comprising:

an insulated housing comprising a top wall and a side wall mounted to the top wall, the side wall extending downwardly from the top wall to define an interior configured to receive a refill container comprising a liquid, the insulated housing open at an end opposite the top wall;

a base mounted to the open end of the housing opposite the top wall at a first mounting interface which forms a gas-tight seal, the base comprising a side wall extending downwardly from the side wall of the housing and a floor mounted to the side wall of the base, the floor configured to enclose the interior of the housing;

a sloped surface mounted within the interior of the housing and configured to induce the liquid within the refill container to flow toward a dispensing aperture configured to receive a spout of the refill container at a second mounting interface which forms another gas-tight seal, through which spout the liquid is dispensed from the system; and a pump assembly in fluid communication with the interior of the housing, the pump assembly comprising a gas source and configured to deliver a gas from the gas source to the interior of the housing to apply pressure to the refill container, wherein the side wall of the housing and the side wall of the base together define the dispensing aperture, and the second mounting interface extends from the first mounting interface.

2. The system of claim 1, wherein the top wall of the housing and the side wall of the housing are double walls.

3. The system of claim 2, wherein the double walls are evacuated to form a vacuum.

4. The system of claim 1, wherein the side wall of the housing is shaped as a cylinder.

5. The system of claim 1, wherein the sloped surface is provided by the base mounted to the housing, or an insert mounted within the interior of the housing, or both.

6. The system of claim 5, wherein the sloped surface is also curved to form a channel extending from a back edge of the sloped surface to an opposing front edge.

7. The system of claim 1, wherein the gas source is one or more pumps.

8. The system of claim 1, wherein the gas source is positioned within an interior of the base mounted to the open end of the housing opposite the top wall.

9. The system of claim 1, wherein a portion of the floor is elevated such that the portion of the floor extends into the interior of the housing.

10. The system of claim 9, wherein the floor is sloped to provide the sloped surface.

11. The system of claim 1, further comprising the refill container.

12. The system of claim 11, wherein the refill container is filled with the liquid and the liquid is wine.

13. The system of claim 1, further comprising a belt mounted to the housing and the base, the belt comprising an elongated portion having opposing ends and extending around perimeters of the housing and the base and around the first mounting interface, and a buckle portion configured to bring the opposing ends of the elongated portion together so the elongated portion conforms to outer surfaces of the housing and the base.

14. The system of claim 8, wherein the gas source is one or more hand pumps.

15. A method of dispensing a liquid using the system of claim 1, the method comprising:

inserting the refill container into the interior of the housing;

dispensing a portion of the liquid within the refill container through the spout;

delivering gas from the gas source to the interior of the housing, thereby applying pressure to the refill container; and dispensing an additional portion of the liquid within the refill container through the spout.

* * * * *